United States Patent [19]

McCloskey

[11] Patent Number: 4,557,453

[45] Date of Patent: Dec. 10, 1985

[54] GURNEY ATTACHMENT

[76] Inventor: Glenn A. McCloskey, 4022 Lonnie St., Oceanside, Calif. 92056

[21] Appl. No.: 614,125

[22] Filed: May 25, 1984

[51] Int. Cl.[4] ..... E04G 3/00

[52] U.S. Cl. ..... 248/287; 248/283

[58] Field of Search ..... 248/283, 291, 447.2, 248/282, 278, 287, 230, 296; 297/149, 150; 108/26; 5/507

[56] References Cited

U.S. PATENT DOCUMENTS

| | | | |
|---|---|---|---|
| 937,480 | 10/1909 | Smith et al. | 248/287 |
| 2,747,322 | 5/1956 | Egghen | 248/447.2 X |
| 2,754,167 | 7/1956 | Young | 108/26 X |
| 3,313,511 | 4/1967 | Koerner et al. | 248/499 |
| 3,606,450 | 9/1971 | Sedgwick | 297/149 |
| 3,762,673 | 10/1973 | Koslovsky | 108/26 X |
| 4,113,218 | 9/1978 | Linder | 5/507 X |
| 4,117,782 | 10/1978 | Cahill | 248/345.1 X |
| 4,262,872 | 4/1981 | Kodet | 248/291 X |

*Primary Examiner*—J. Franklin Foss

*Attorney, Agent, or Firm*—Charmasson & Holz

[57] ABSTRACT

An attachment for a gurney used to transport patients in hospitals and to and from ambulances and the like comprises a tray having legs at each side with adjustable devices for attaching the tray to the opposite side handrails of the gurney such that its height and position over a patient on the gurney can be adjusted. A swivelling support mounted on the tray is adapted to carry a heart monitor and defibrillator apparatus.

4 Claims, 4 Drawing Figures

FIG. 1
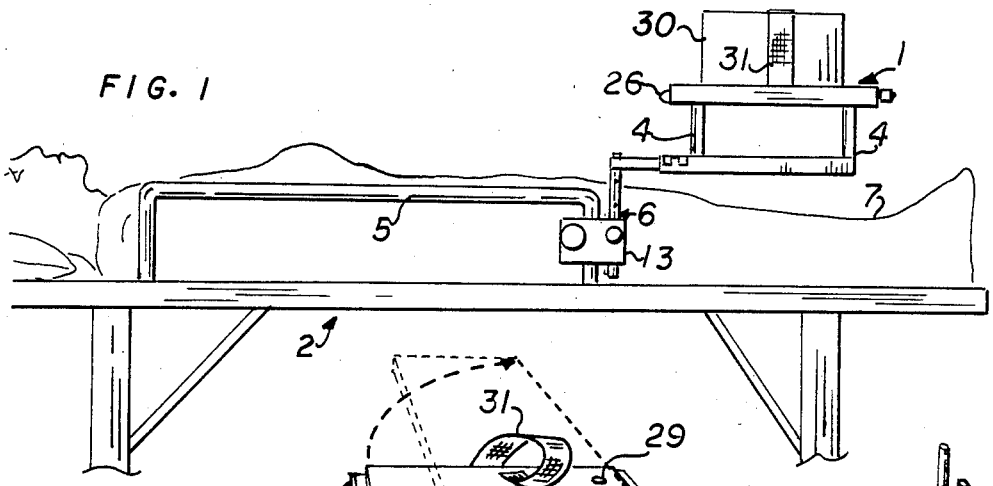
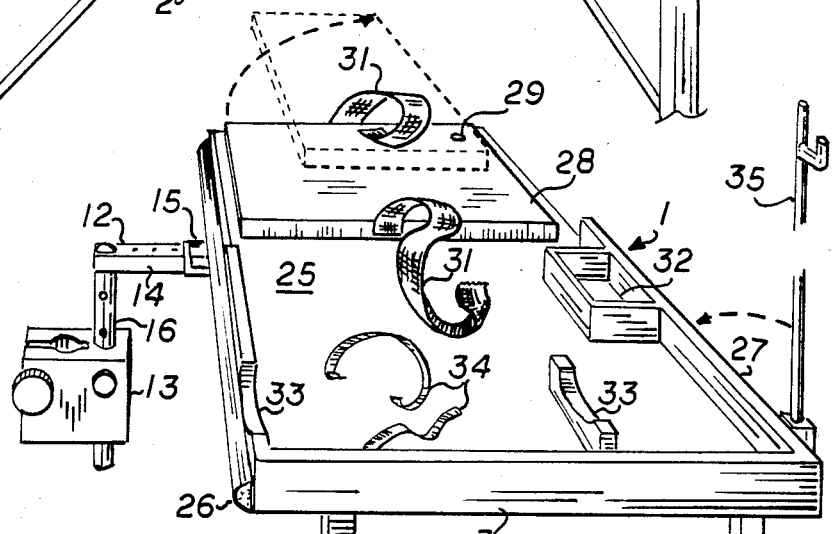
FIG. 2
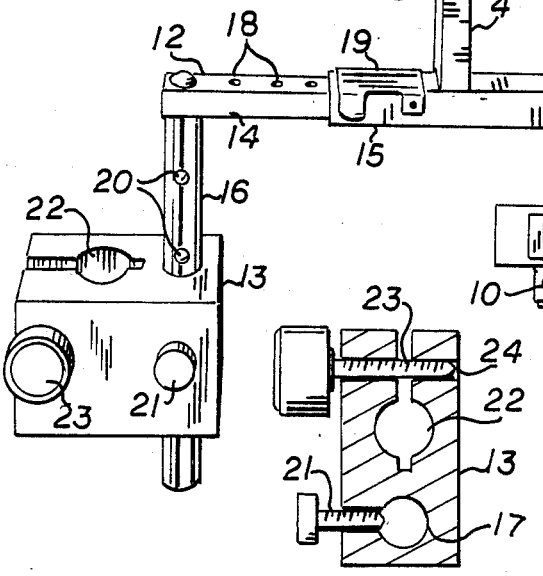
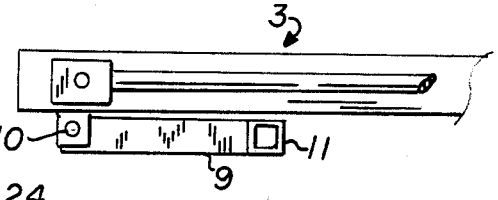
FIG. 4
FIG. 3

GURNEY ATTACHMENT

BACKGROUND OF THE INVENTION

The present invention relates to a gurney accessory or attachment for supporting life-sustaining and other medical devices for easy access by medical personnel during transport of a patient on a gurney in an emergency medical situation.

In medical emergencies time is of the essence and it is vitally important to have all necessary medical equipment and supplies, such as monitoring and life-sustaining devices and various medicines, readily on hand for use by paramedics, doctors and so on, while the patient is transported to and from an ambulance, emergency room, operating room or intensive care ward.

SUMMARY OF THE INVENTION

It is an object of this invention to provide an attachment for a gurney which can readily support a variety of life-sustaining devices and medical equipment such that they are easily accessible to the medical staff during transport of a patient.

According to the present invention an attachment for a gurney for transporting patients comprises a tray for supporting medical equipment and supplies, and securing devices for adjustably supporting the tray above the gurney such that its height and horizontal position over the gurney can be adjusted. Thus the location of the tray over a patient can be adjusted as necessary.

In a preferred embodiment the tray has downwardly depending legs at each side edge, and adjustable clamping devices are provided for securing each leg to the side handrails of the gurney such that the vertical and horizontal position of the tray can be adjusted.

The legs are preferably foldable flat under the tray when the attachment is not in use.

A swivelling support suitable for carrying heart monitor and defibrillator apparatus is mounted on a swivel at one end of the tray. The support has straps for firmly gripping the heart defibrillator apparatus in place. Thus the apparatus can be moved to new positions without taking it off the support by rotating the support about the swivel, and can be readily viewed and used when necessary while a patient is being transported on the gurney.

The tray preferably also has a box for carrying a variety of medications, needles, and so on of the type needed in emergency medical situations.

An IV support pole may be mounted at one edge of the tray so as to be rotatable between a position aligned with the tray when not in use and a raised, vertical position when the transported patient requires an IV. A cradle for supporting an oxygen bottle may be provided on the tray. Further straps for supporting other instruments or supplies on the tray may be provided.

The tray may be provided with one or more bumper pads around its edges to protect the patient and medical staff from injury.

The gurney attachment thus allows several life-support instruments and medications to be supported above a patient being transported on a gurney, so that these can be used without delay in the event of any emergency occurring during transport.

BRIEF DESCRIPTION OF THE DRAWINGS

FIG. 1 is a side view of a gurney attachment according to a preferred embodiment of the invention attached to the side handrails of a gurney transporting a patient;

FIG. 2 is a perspective view of the gurney attachment;

FIG. 3 is a partial horizontal cross-section through a device for adjustably clamping the gurney attachment to the side handrails of a gurney; and FIG. 4 is a partial right hand side view of the gurney attachment as shown in FIG. 2 with its legs in a collapsed position.

DESCRIPTION OF THE PREFERRED EMBODIMENT

FIGS. 1 and 2 show an accessory or attachment 1 for a gurney 2 used to transport patients, for example between ambulances and hospital emergency rooms or wards, or to and from operating rooms and intensive care wards. In an emergency medical situation it is important that the necessary medical equipment and supplies are always readily at hand, and thus the attachment is designed to support such equipment and supplies on the gurney in easily accessible positions.

The gurney attachment 1 basically comprises a tray 3 with downwardly depending legs 4 at each side which can be adjustably attached to the opposite side handrails 5 of the gurney 2 by means of the adjustable clamping devices 6 to support the tray 3 above a patient 7 being transported on the gurney.

Each leg 4 comprises a pair of side members 8, 9 pivotally attached by means of pins 10 to the undersurface of the tray 3, as shown in FIG. 4, and connected at their lower ends by a hollow cross-member 11. The legs 4 can be pivoted inwards about the pins 10 between the vertical position shown in FIGS. 1 and 2 and the collapsed position under the trays, as shown in FIG. 4, when not in use. A suitable locking mechanism (not shown) may be provided for locking the legs in their vertical or collapsed positions.

The clamping devices 6 each comprise an L-shaped leg member 12 and a releasable clamping member 13 for securing the leg member 12 to a respective one of the guraney handrails 5. Each leg member has a first portion 14 adapted to engage horizontally in an extension 15 of the hollow cross member 11 of a respective one of the legs, and a second portion 16 adapted to engage vertically in bore 17, shown in FIG. 3, in a respective one of the clamping members 13.

The first portion 14 of each leg member is of square cross-section and has a series of holes or bores 18 along its length. The portion 14 is slidable in and out of the cross member 11, and can be held in a chosen position by means of a pin (not shown) beneath pivotable cover plate 19 projecting through a hole in the extension 15 into a selected one of the holes or bores 18.

Similarly, the second portion 16 of each leg member 12, which is of round cross-section, has a series of holes or bores 20 along its length so that it can be secured at a chosen vertical extension above the gurney by means of a pin 21 which projects into the bore 17 of the clamping member 13 as shown in FIG. 3 to engage in one of the bores or holes 20.

Each clamping member 13 is provided with a second vertical bore 22 which can be tightened around a respective one of the handrails 5 by means of clamping screw 23 engaging in screwthreaded cross bore 24, as shown in FIG. 3.

Thus the vertical and horizontal positions of the tray 3 over the patient 7 can be easily adjusted by releasing the pins holding each portion of the leg members 12 and sliding the portions to a new position before re-engaging the pins As seen in FIG. 2, the tray 3 has a flat support surface 25 having various supporting devices for the usual medical equipment and supplies. A soft bumper 26, suitably of rubber, is provided along the edge of the tray facing the patient 7 to reduce the risk of injury to the patient or to medical personnel. One side half of the support surface 25 is surrounded by a raised edge 27, while a swivelling support plate 28 is pivotally mounted on pin 29 on the other half of the support surface 25. The support plate 28 is intended to carry a heart monitor and defibrillator instrument 30, as shown in FIG. 1. The instrument is securely supported on the plate 28 by means of a belt 31 which can be secured around the instrument 30 by means of a buckle, Velcro (Registered Trade Mark) strips or other suitable attachment. The support plate 28 can be swivelled out around the pivot pin 29 to the dotted line position shown in FIG. 2 when necessary for easier access to the carried instrument 30.

A medicine box 32 is provided on the tray for holding a selection of medications, needles, and the like often needed in emergencies. A cradle 33 is provided to support gas cylinders, such as an oxygen cylinder when a patient is having breathing difficulties. A suitable belt 34 is provided for holding a gas cylinder in the cradle.

An IV support pole 35 is pivotally mounted to one edge of the tray 3, and can be pivoted into the raised position shown in FIG. 2 when the patient requires an IV, and into the lowered position shown in FIG. 4 where it is aligned with the tray when it is not in use.

The remaining space on the tray may be used for carrying any other necessary medical equipment and supplies.

The the tray can be secured to the gurney at the appropriate height and position, and the appropriate equipment and supplies can be supported on the tray, whenever a patient is transported. This is particularly advantageous when critical or emergency patients are transported, since the medical personnel can constantly monitor the patient and have the necessary equipment and supplies readily at hand should an emergency suddenly arise.

Although a preferred embodiment of the invention has been described by way of example, it will be understood that modifications may be made which are within the scope of the invention, which is defined by the appended claims.

What is claimed is:

1. An attachment for a gurney having side handrails for transporting a patient, comprising:

a tray for supporting medical equipment, said tray having a cradle for supporting a gas bottle, a resilient bumper along an edge facing the patient on said gurney and an IV pole pivotally attached to one edge of the tray so as to pivot between a rest position aligned with the tray edge and a raised vertical position;

securing means for adjustably securing the tray to the side handrails;

said securing means comprising a pair of downwardly depending legs at each side of the tray, a horizontal cross-bar jointing the base of each pair of legs, a pair of releasable clamp members for clamping to the opposite side handrail, and a pair of leg members each having a first portion for adjustable horizontal attachment to a respective one of said cross-bars and a second portion for adjustable vertical attachment to a respective one of said clamps, and a swivelling support for a heart monitor device, said swivelling support being pivotally mounted on said tray so as to be movable from a position over the tray to a position to one side of the tray.

2. The attachment of claim 1, wherein said legs are collapsible into a folded flat position under said tray when the tray is not in use.

3. The attachment of claim 1, wherein said leg members are L-shaped, and means are provided for adjustably attaching each of said leg members at one end to a respective one of said tray legs and at the other end to a respective one of said clamp members.

4. The attachment of claim 1, wherein straps are provided on said support for securing said device in place.

* * * * *